US008425315B2

(12) United States Patent
Kamano

(10) Patent No.: US 8,425,315 B2
(45) Date of Patent: Apr. 23, 2013

(54) GAMING MACHINE AND EXTENDED DEVICE CONNECTED THERETO

(75) Inventor: Kenichi Kamano, Zama (JP)

(73) Assignee: Konami Gaming Incorporated, Las Vegas, NV (US)

( * ) Notice: Subject to any disclaimer, the term of this patent is extended or adjusted under 35 U.S.C. 154(b) by 0 days.

(21) Appl. No.: 13/456,518

(22) Filed: Apr. 26, 2012

(65) Prior Publication Data

US 2012/0282999 A1 Nov. 8, 2012

(30) Foreign Application Priority Data

May 3, 2011 (AU) ..... 2011202038

(51) Int. Cl.
*A63F 9/24* (2006.01)

(52) U.S. Cl.
USPC ..... 463/29; 463/16; 463/20; 463/25; 463/42

(58) Field of Classification Search ..... 463/29, 463/42
See application file for complete search history.

(56) References Cited

U.S. PATENT DOCUMENTS

| | | | |
|---|---|---|---|
| 5,356,144 | A | 10/1994 | Fitzpatrick et al. |
| 2007/0155505 | A1 | 7/2007 | Huomo |
| 2008/0171599 | A1 | 7/2008 | Salo et al. |
| 2009/0005156 | A1 | 1/2009 | Saito |
| 2010/0081493 | A1 | 4/2010 | Kamano |

OTHER PUBLICATIONS

European Search Report (date of completion of the search Aug. 9, 2012).

*Primary Examiner* — Omkar Deodhar
(74) *Attorney, Agent, or Firm* — Howard & Howard Attorneys PLLC

(57) ABSTRACT

A gaming machine comprising a external storage device provided with a first game region in which a first game file containing a program and data to realize a first game is stored and a second game region in which a second game file containing a program and data to realize a second game is stored, in which the first game and the second game are selectively played, and an extended device connected to the gaming machine as a physically separate device from the external storage device, wherein the extended device is provided with a determination device that determines whether a predetermined condition is met and a switching device that switches a game played in the gaming machine between the first game and the second game when the predetermined condition is met based on a determination result of the determination device.

17 Claims, 8 Drawing Sheets

GAMING MACHINE AND EXTENDED DEVICE CONNECTED THERETO

CROSS REFERENCE TO RELATED APPLICATION

This application claims priority to Australian Patent Application No. 2011202038, filed May 3, 2011, the disclosure of which is hereby incorporated by reference in its entirety.

FIELD OF THE INVENTION

The present invention relates to a gaming machine in which a plurality of games is played selectively.

DESCRIPTION OF THE RELATED ART

Gaming machines equipped with an extended device that adds another function to symbols used in a game are known (see, for example, U.S. Pub. No. US2010/0081493). In addition, as prior art documents related to the present invention, U.S. Pub. No. US2007/0155505, U.S. Pub. No. US2008/0171599, and U.S. Pat. No. 5,356,144 are known.

SUMMARY OF THE INVENTION

Some games require making an application to obtain approval and licenses before modifying or adding game file content, etc. In the gaming machine of U.S. Pub. No. US2010/0081493, another function is added to symbols used in a game by an extended device, thereby changing the nature of the game. Thus, when an existing game is provided to customers by adding an extended device, if approval and licenses of the extended device are obtained, a new game obtained by changing the nature of a game can be provided without making a reapplication for the gaming machine obtained by adding the extended device. However, if a gaming machine is configured to be able to play a plurality of games, the extended device of U.S. Pub. No. US2010/0081493 simply causes the same change in any game uniformly. If, for example, the extended device adds a function to set the payout ratio to 85% of a game in which payout is performed, the extended device of U.S. Pub. No. US2010/0081493 can only cause a change of similarly setting the payout ratio to 85% of any game played in the gaming machine. Thus, if a different change should be caused for each game, it is necessary to prepare a plurality of extended devices. Alternatively, an extended device in which a plurality of programs etc. each corresponding to different changes are stored is needed. On the other hand, when, for example, the nature of a game to be changed is the prize-winning ratio, payout ratio of the game, or the like, another game having data corresponding to the changed prize-winning ratio or the like may be present in the gaming machine in advance. However, each game played in the gaming machine is generally configured to be played alternatively. Thus, data of another game and the like cannot be used in one game played in the gaming machine.

An object of the present invention is to provide a gaming machine which is capable of playing a new game by combining each existing game and an extended device connected thereto.

A gaming machine of the present invention comprises: a game file storage device provided with a first game region in which a first game file containing a program and data to realize a first game is stored and a second game region in which a second game file containing a program and data to realize a second game is stored, in which the first game and the second game are selectively played, and an extended device connected to the gaming machine as a physically separate device from the game file storage device, wherein the extended device is provided with a determination device that determines whether a predetermined condition is met and a switching device that switches a game played in the gaming machine between the first game and the second game when the predetermined condition is met based on a determination result of the determination device.

An extended device of the present invention is connected to a gaming machine, the gaming machine including a game file storage device provided with a first game region in which a first game file containing a program and data to realize a first game is stored and a second game region in which a second game file containing a program and data to realize a second game is stored, and the first game and the second game are selectively played therein, wherein the extended device is connected to the gaming machine as a physically separately device from the game file storage device, the extended device comprises: a determination device that determines whether a predetermined condition is met; and a switching device that switches a game played in the gaming machine between the first game and the second game when the predetermined condition is met based on a determination result of the determination device.

DESCRIPTION OF THE EMBODIMENTS

Figure 1:
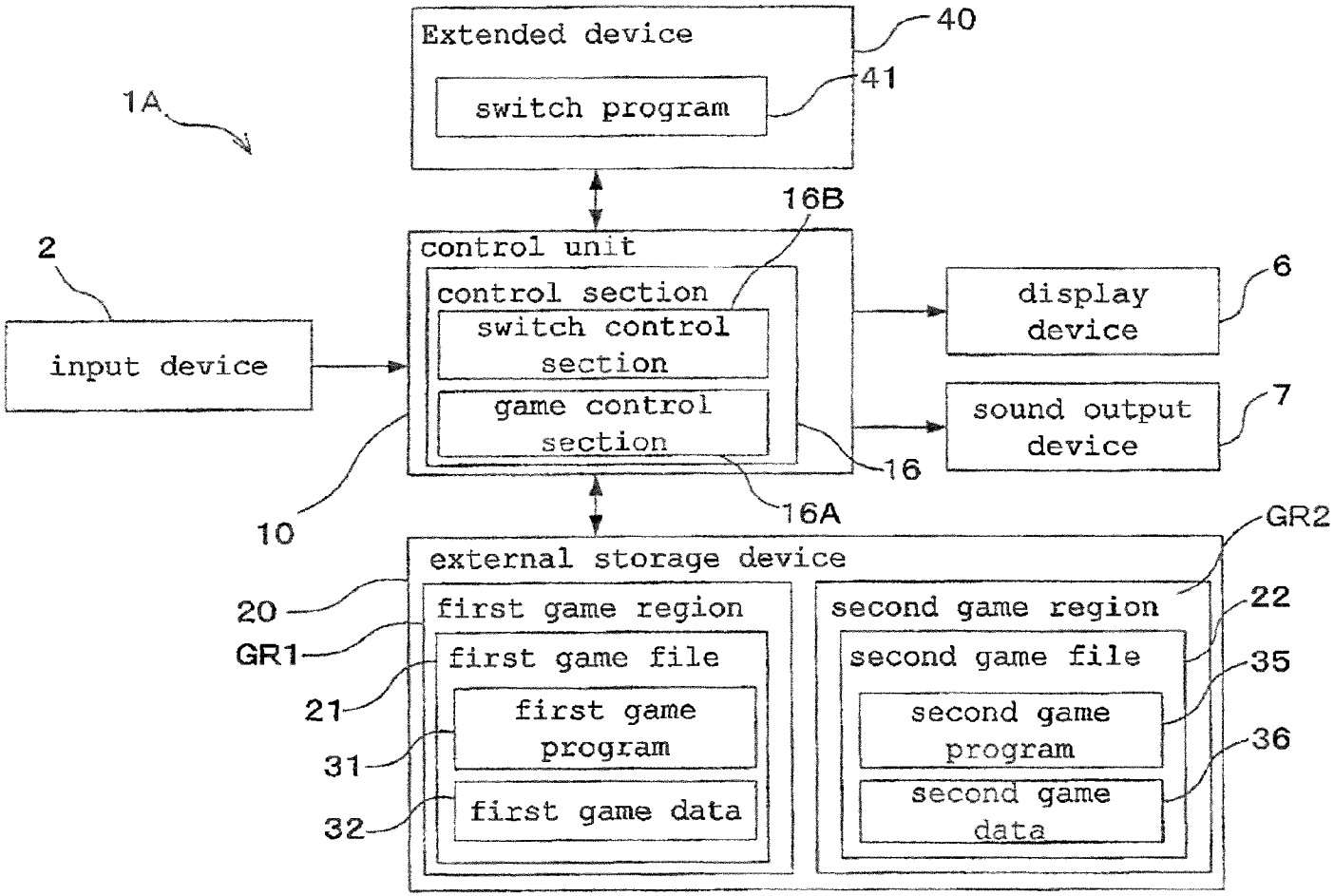
FIG. 1 is a functional block diagram of a gaming machine to which an extended device according to an embodiment of the present invention is applied.

Hereinafter, a gaming machine to which an extended device according to an embodiment of the present invention is applied will be described with reference to the drawings. FIG. 1 is a functional block diagram of a gaming machine 1A to which an extended device according to an embodiment of the present invention is applied. As shown in FIG. 1, the gaming machine 1A includes an input device 2, a display device 6, a sound output device 7, and a control unit 10. The input device 2 is used to input an operation etc. of a player. The input device 2 includes, for example, a keyboard, a mouse, and a touch panel, etc. The display device 6 is used to display a game screen, etc. The display device 6 includes a monitor and projector, etc. The sound output device 7 is used to output sound such as sound effects and BGM. The sound output device 7 includes a speaker, etc. The devices 2, 6, 7 are each connected to the control unit 10.

The control unit 10 is configured as a computer unit combining a microprocessor and various peripheral devices such as internal storage devices (as an example, ROM and RAM) necessary for operation of the microprocessor. The control unit 10 also includes a control section 16 as a control body that controls progress of games played in the gaming machine 1A and various devices. The control section 16 controls output of a video signal to cause the display device 6 to display a predetermined image, and output of a sound reproduction signal to cause the sound output device 7 to reproduce a predetermined sound, etc.

An external storage device 20 as a game file storage device is connected to the control unit 10. As the external storage device 20, a storage medium capable of holding storage without feeding of power is used, for example, an optical storage medium such as a DVD-ROM and a CD-ROM, a nonvolatile semiconductor memory device such as an EEPROM, or a hard disk. With the external storage device 20 being connected, the control section 16 can use various kinds of data etc. stored in the external storage device.

A first game region GR1 and a second game region GR2 are provided in the external storage device 20. The first game region GR1 is a region to store a first game file 21. On the other hand, the second game region GR2 is a region to store a second game file 22. The first game file 21 contains a program and various kinds of data to realize a first game played in the gaming machine 1A and the second game file 22 contains a program and various kinds of data to realize a second game played in the gaming machine 1A.

More specifically, the first game file 21 contains a first game program 31 and first game data 32. The second game file 22 contains a second game program 35 and second game data 36. Both of the first game program 31 and the second game program 35 are programs necessary to cause the gaming machine 1A to play the games. On the other hand, the first game data 32 contains various kinds of information used when the first game program 31 is executed and the second game data 36 contains various kinds of information used when the second game program 35 is executed. The first game program 31 and the second game program 35 contain various program modules necessary to play respective games, however an illustration thereof is omitted. In addition, the first game data 32 and the second game data 36 contain various kinds of data such as image data and sound data to be used to realize respective games, however an illustration thereof is also omitted.

The control section 16 performs various kinds of necessary processes for operation as the gaming machine 1A by executing an operation program stored in the internal storage device. Subsequently, the control section 16 reads each of the game programs 31, 35 from the external storage device 20 to execute the programs. By executing each of the game programs 31, 35, the control section 16 sets the environment to play the game following each of the game programs 31, 35. A game control section 16A is generated in the control section 16 by each of the game programs 31, 35 being executed. The game control section 16A is a logical device realized by a combination of computer hardware and a computer program. The game control section 16A is in charge of processing to play a game such as instructing to start the game or instructing to proceed with the game or the like of processing performed by the control section 16. When the first game program 31 is used and when the second game program 35 is used, game environments separated from each other are set and separate games independent of each other played alternatively are played.

An extended device 40 is also connected to the control unit 10. The extended device 40 is physically a separate device from the external storage device. In the extended device 40, a switch program 41 is stored. The switch program 41 adds a new function to the gaming machine 1A by being executed by the control section 16. A switch control section 16B is generated in the control section 16 by the switch program 41 being executed. The switch control section 16B is also a logical device realized by a combination of computer hardware and a computer program. The switch control section 16B is in charge of processing to switch a game such as determining whether a predetermined condition is met or switching to the game to be played next time or the like of processing performed by the control section 16. Other logical devices can also be generated in the control section 16, however an illustration thereof is omitted.

Figure 2:
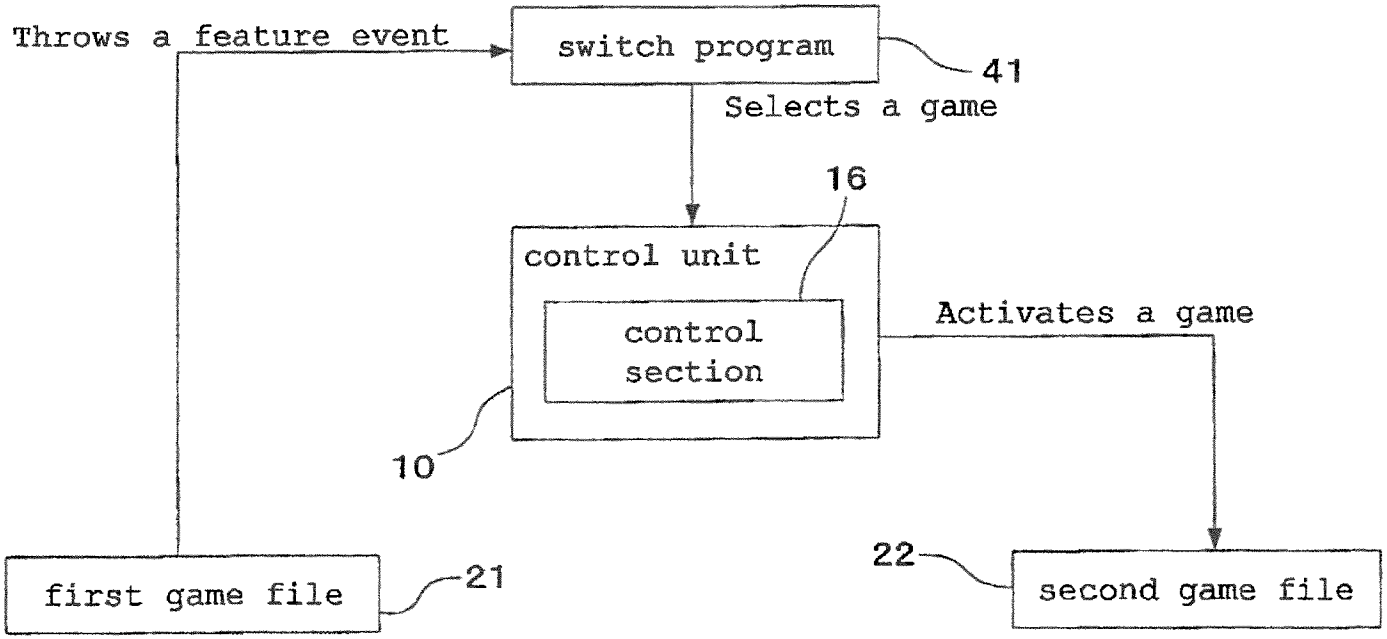
FIG. 2 is an explanatory view illustrating the relationship between a switch program and each piece of game data.

Next, the function added by the switch program 41 will be described. FIG. 2 is an explanatory view illustrating the relationship between the switch program 41 and each of the game files 21, 22. FIG. 2 shows a case when the switch program 41 is executed while the first game using the first game file 21 is being played. As shown in FIG. 2, when the predetermined condition for causing an event is met in the first game by the first game file 21, the switch program 41 causes the control section 16 to perform processing so that the second game by the second game file 22 is played as the next game. Based on the function of the switch program 41 described above, the control section 16 reads the program 35 etc. contained in the second game file 22. Then, the control section 16 switches the game to be played in the gaming machine 1A next time from the first game by the first game file 21 of this time to the second game by the second game file 22. That is, the switch program 41 adds the function to switch the game to be played next time from the first game to the second game when the predetermined condition is met. In this case, the switch program 41 may be configured to add also the function to cause the display device 6 to display a screen to allow a player to select whether to switch to the second game as the next game, along with characteristics of the second game using the second game file 22.

Figure 3:
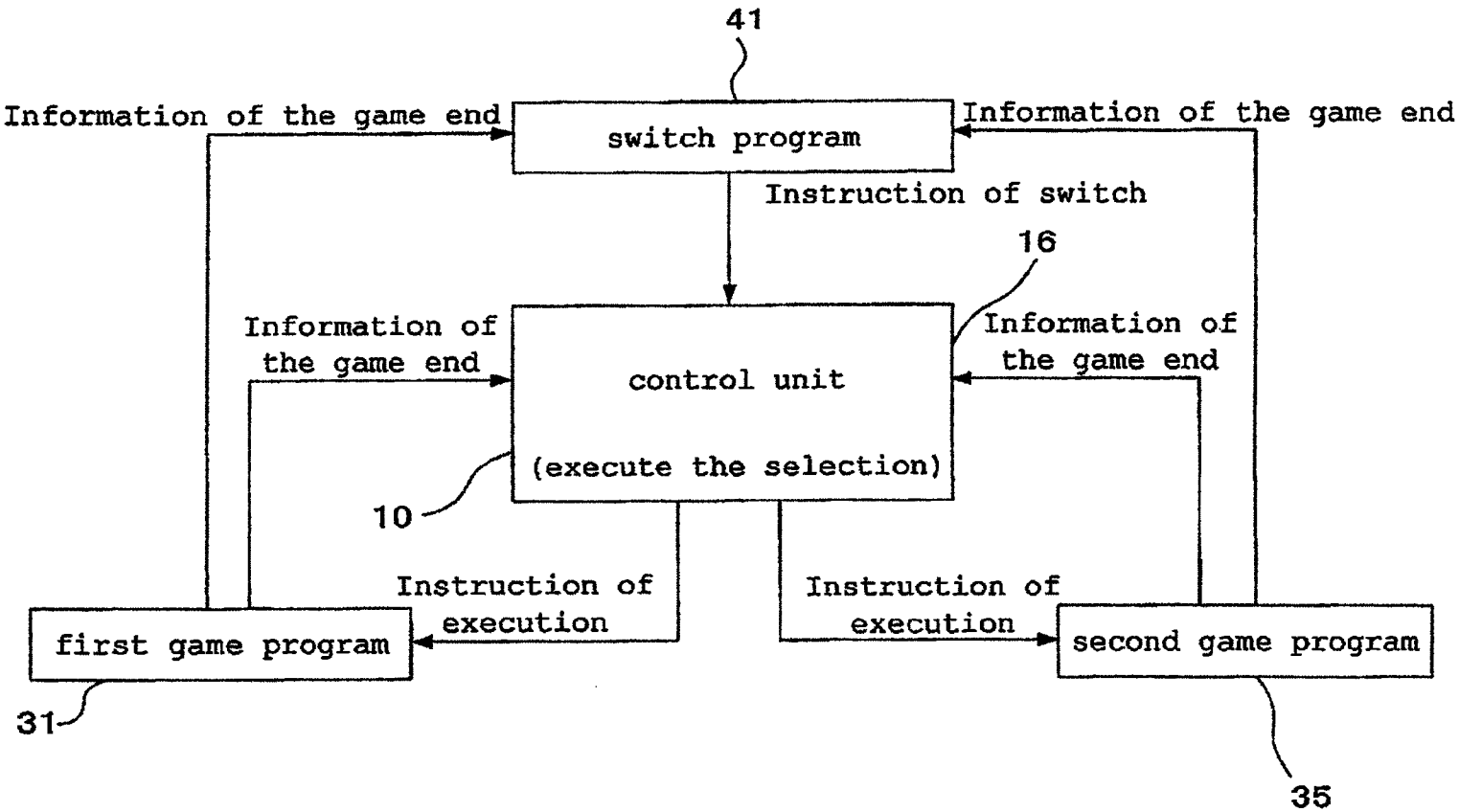
FIG. 3 is a software functional diagram illustrating a function added by the switch program.

FIG. 3 is a software functional diagram illustrating the function added by the switch program 41. As shown in FIG. 3, information of the end of the game based on the first game program 31 and information of the end of the game based on the second game program 33 are used by the function added by the switch program 41. Information of the end of the game based on each of the game programs 31, 35 may be indirectly used by the switch program 41. Information of the end of a game used by the switch program 41 may contain information of the end of an event end or information about game results. The switch program 41 uses information of the game end of each of the programs 31, 35 for the switching instruction of the game or the instruction of game selection. Based on the switching instruction of the game obtained by the switch program 41, etc., the control section 16 makes a selection of the game to be played next time. Then, the game based on the selected program of each of the programs 31, 35 is played as the next game. In FIG. 3 as a software functional diagram, arrows corresponding to input/output of each piece of information by using each of the programs 31, 35, 41 are illustrated for convenience sake, however actually the game control section 16A issues instructions of acquisition or output of information of the game end or game playing, etc. and the switch control section 16B issues instructions of game switching or game selection. Details of the processing performed by the game control section 16A and the switch control section 16B will be described below.

Figure 4:
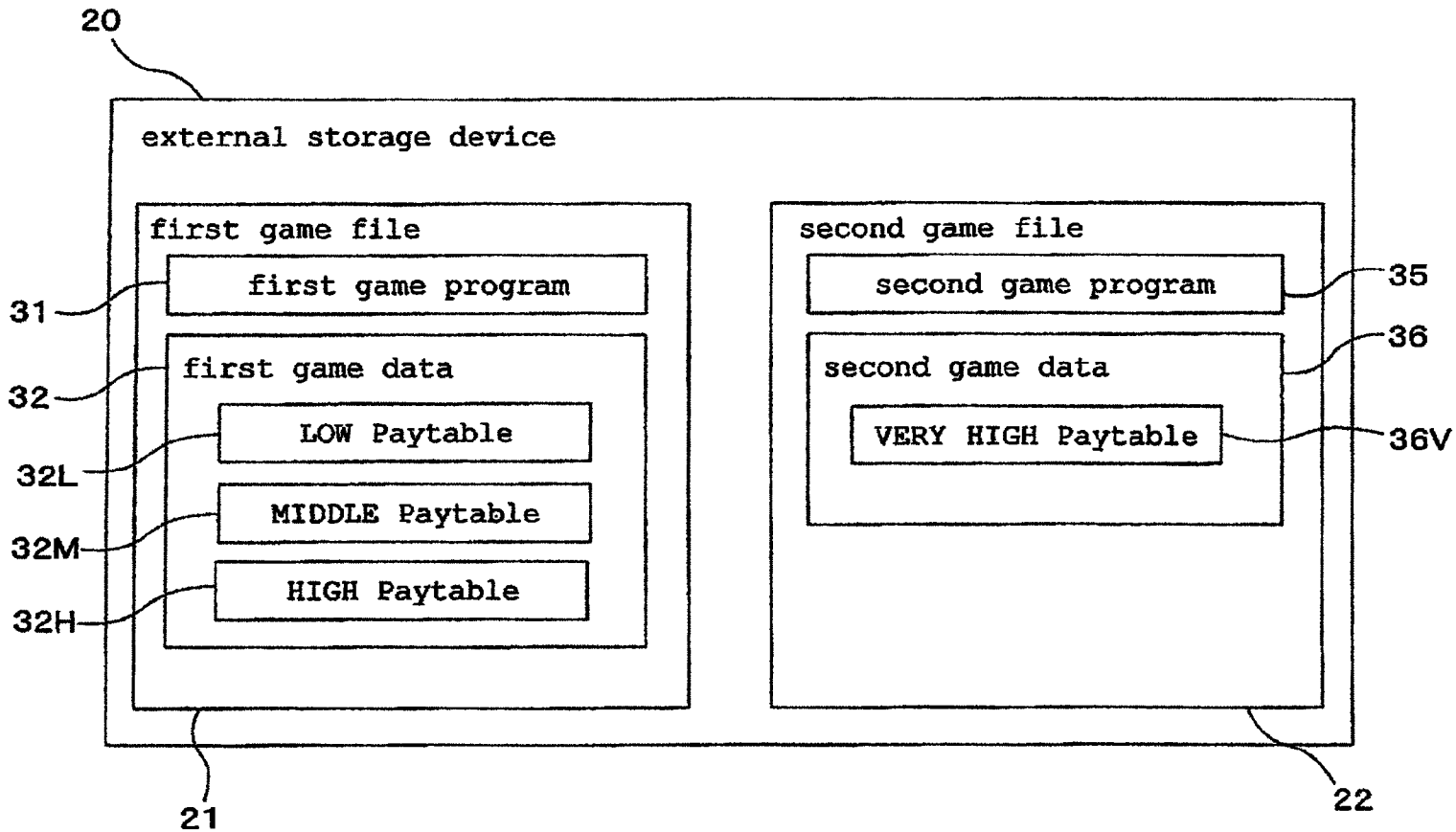
FIG. 4 is a diagram showing details of an example of each piece of game data corresponding to each game played in the gaming machine.

Next, an example of each game played in the gaming machine 1A will be described with reference to FIG. 4. FIG. 4 is a diagram showing details of an example of each of the game files 21, 22 corresponding to each game played in the gaming machine 1A. In the example in FIG. 4, each of the game files 21, 22 is configured so that the play is started by consuming a predetermined game value and with the play start, a game providing an opportunity to establish a predetermined prize-winning condition is played. The game value contains not only money, however also symbols of value such as coins, chips and medals. The game screen may be provided with a bet field and a credit field. The bet field shows the number or amount etc. of game values bet on one game by the player. The credit field shows the number or amount etc. of game values that the gaming machine 1A currently keeps for the player as game value which can be bet on games. The game value is consumed each time the player bets on a game and the number or amount etc. of game values in the credit field decreases. The gaming machine 1A may be configured in this manner so that an opportunity to play a game is provided by using the bet field and the credit field.

In each game in which each of the game files 21, 22 is executed, when a predetermined prize-winning condition is met during the play, the game value as a benefit is paid out to the player. Payout of the game value to the player is executed following each Paytable contained in each of the game files 21, 22. Each of the game files 21, 22 has a plurality of Paytables provided for different payout ratios of the game value. The payout ratio shows the theoretical ratio of the amount of the game value paid out to the player to the amount of consumption of the game value. That is, the payout ratio is a theoretical value obtained by dividing the amount of paid-out game value by the amount of consumption of the game value (amount of paid-out game value/amount of consumption of the game value). Each of the game files 21, 22 contains different Paytables with mutually different payout ratios. That is, in the example in FIG. 4, each of the game files 21, 22 is configured to play the same game in which an opportunity to win a prize is offered with the consumption of game value, wherein the game uses each Paytable of mutually different payout ratio. The payout may be provided as an increase in the credit field.

In this example, as shown in FIG. 4, the first game data 32 of the first game file 21 contains three Paytables with different payout ratios; LOWPaytable 32L, MIDDLEPaytable 32M, and HIGHPaytable 32H. The payout ratio of the Paytables 32L, 32M, 32H increases in the order of LOWPaytable 32L, MIDDLEPaytable 32M, and HIGHPaytable 32H. That is, the payout ratio favorably affects the player in the order of LOWPaytable 32L, MIDDLEPaytable 32M, and HIGHPaytable 32H. On the other hand, the second game data 36 of the second game file 22 contains VERYHIGHPaytable 36V. VERYHIGHPaytable 36V has a payout ratio still higher than the payout ratio of HIGHPaytable 32H contained in the first game data 32. Therefore, among these four Paytables 32L, 32M, 32H, 36V, VERYHIGHPaytable 36V affects the player most favorably.

Each game is played alternatively by the player through the gaming machine 1A. On the other hand, if the predetermined condition to cause an event is met, the game played in the gaming machine 1A is switched between the first game and the second game through the function of the extended device 40. For example, if the predetermined condition to cause an event is met while the first game of the first game file 21 using LOWPaytable 32L is played, the game played by the player is switched from the first game by the first game file 21 to the second game by the second game file 22 through the function of the extended device 40. Thus, the second game using VERYHIGHPaytable 36V that is more favorable than a game using most favorable HIGHPaytable 32H occurring in the first game by the first game file 21 is offered to the player. Thus, in the gaming machine 1A, games that are not provided by only one game file are played by games being incorporated into the flow of each game through the function of the extended device 40.

Figure 5:
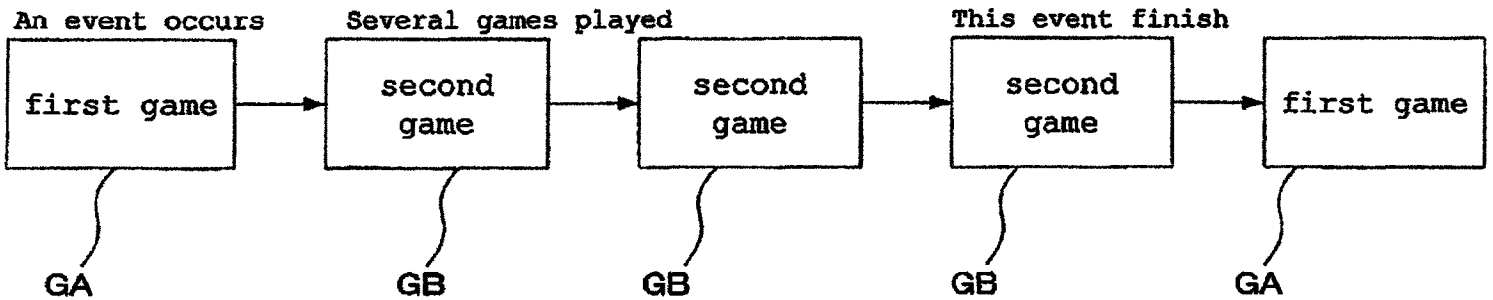
FIG. 5 is an explanatory view illustrating an example of the flow of games played in the gaming machine when switching between each game is executed.

An example of the flow of each game when the switch program 41 is executed will be described with reference to FIG. 5. FIG. 5 is an explanatory view illustrating an example of the flow of the games played in the gaming machine 1A when switching between each game is executed. In this example, as shown in FIG. 5, when the predetermined condition to cause an event is met in a first game GA using the first game file 21, an opportunity to play a second game GB using the second game file 22 is provided by the switch program 41 a fixed number of times (three times in the example in FIG. 5). At this point, guidance of switching from the first game GA to the second game GB is provided along with characteristics of the second game GB. After the second game GB is played three times, the opportunity to play the second game GB ends and the game played in the gaming machine 1A is returned to the first game GA again. At this point, guidance that the game played in the gaming machine 1A is returned to the first game GA may be provided. The predetermined event and the number of times that the second game GB (the game which is switched, and which is used as an event) is played after the predetermined event occurs are set by the administrator of the gaming machine 1A.

Figure 6:
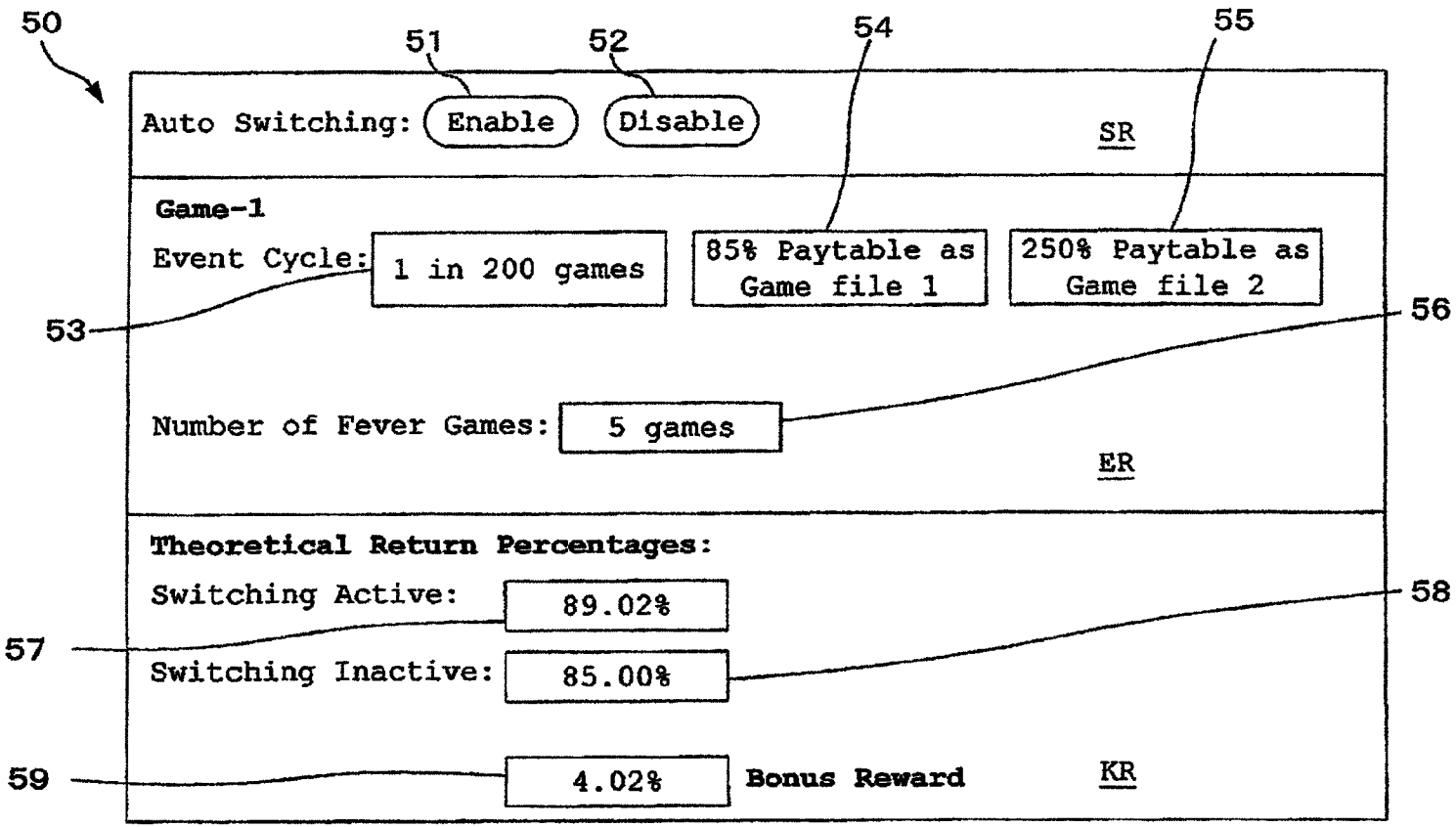
FIG. 6 is a diagram exemplifying a setting screen when each piece of game data shown in FIG. 5 is used.

Settings of the predetermined event and the like by the administrator are made through, for example, a setting screen. The function to display the setting screen, etc. may be added through the switch program 41. FIG. 6 is a diagram exemplifying the setting screen when each of the game files 21, 22 shown in FIG. 5 is used. As shown in FIG. 6, a setting screen 50 includes an Auto Switching setting region SR to enable/disable the switch program 41, an event setting region ER to set a condition for an event, and a setting result reference region KR to refer to setting results.

An enable button 51 to enable the switch program 41 and a disable button 52 to disable the switch program 41 are provided in the Auto Switching setting region SR. When the enable button 51 is set in the setting screen 50, the switch program 41 is executed, and when the predetermined condition for causing the event is met, the game is automatically switched. On the other hand, when the disable button 52 is selected, the switch program 41 is disabled and the game is not switched even if the predetermined condition is met.

A Cycle field 53, a target game setting field 54, an event game field 55, and an end condition setting field 56 are provided in the event setting region ER. The Cycle field 53 is used to input Event Cycle. In this example, the Cycle field 53 is used to set a predetermined condition for causing an event. That is, Cycle in which an event should be caused is entered in the Cycle field 53. The target game setting field 54 is used to set the game to be counted for Cycle entered in the Cycle field 53. The event game field 55 is used to set the game caused as an event when the game set in the target game setting field 54 meets the Cycle condition in the Cycle field 53. The end condition setting field 56 is used to set the condition for ending the event. In this example, the number of times of playing the game set in the event game field 55 is used as the event end condition. Thus, the number of times of playing the game set in the event game field 55 as an event is entered in the end condition setting field 56.

The setting result reference region KR is provided with a Switching Active field 57, a Switching Inactive field 58, and a Bonus Reward field 59. In these fields 57, 58, 59, results in accordance with content set in the event setting region ER are displayed. More specifically, the payout ratio of the game value according to setting results in the event setting region ER while the switching program 41 is enabled is displayed in the Switching Active field 57. On the other hand, the payout ratio of the game value while the switching program 41 is disabled is displayed in the Switching Inactive field 58. In the Bonus Reward field 59, the difference of the payout ratio between the Switching Active field 57 and the Switching Inactive field 58 is displayed. The difference of the payout ratio displayed in the Bonus Reward field 59 corresponds to the effect when setting results in the event setting region ER are followed.

In the example in FIG. 6, "1 in 200 Games" is set in the Cycle field 54, "85% Paytable as Game file 1" is set in the target game setting field 54, and "250% Paytable as Game file 2" is set in the event game field 55. "85% Paytable as Game file 1" corresponds to LOWPaytable 32L of the first game file 21. On the other hand, "250% Paytable as Game file 2" corresponds to VERYHIGHPaytable 36V of the second game file 22. "85% Paytable" is a Paytable having the payout ratio of 85% as a theoretical expected value paid out with respect to the amount of consumption of the game value. Similarly, "250% Paytable" is a Paytable having the payout ratio of 250% as a theoretical expected value paid out with respect to the amount of consumption of the game value, that is, the theoretical expected value is 2.5 times the amount of consumption.

In the example in FIG. 6, "5 games" is set in the end condition setting field 56, that is, a setting is made to end the event when the game in the event game field 55 is played five times. Therefore, in the example in FIG. 6, when the first game GA of the first game file 21 using LOWPaytable 32L is played 200 times, the event start condition is met and the event occurs once. As the one-time event, the second game GB of the second game file 22 using VERYHIGHPaytable 36V is played and when the second game GB is played five times, the event of this time ends according to the above setting.

In the example in FIG. 6, "89.02%" is displayed in the Switching Active field 57 and "85.00%" is displayed in the Switching Inactive field 58. That is, results of change are shown that if the switch program 41 is enabled according to setting content in the event setting region ER, the payout ratio of the game value to the player becomes 89.02% and if the switch program 41 is disabled, the payout ratio of the game value becomes 85%. "4.02%" is displayed in the Bonus Reward field 59 as the difference between the two fields 57, 58. That is, the Bonus Reward field 59 is shown that the difference of the payout ratio between when the switch program 41 is enabled and when that is disable according to setting content in the event setting region ER is 4.02%. In other words, as an effect of enabling the switch program 41 according to setting content in the event setting region ER, a result that the player has an advantage of 4.02% in payout ratio is displayed. The administrator managing the gaming machine 1A makes settings concerning the switch program 41 by using the setting screen 50.

The input device 2 is used to make settings concerning the setting screen 50. When, for example, information identifiable as the administrator such as a password is input by using the input device 2, the setting screen 50 is displayed in the display device 6. The input device 2 to make settings in the setting screen 50 and the display device 6 to display the setting screen 50 are not limited to a form in which the input device 2 and the display device 6 are also used for games. For example, an administration device including an input device, display device, and control unit may be separately provided for settings in the setting screen 50. In this case, only connection of the administration device to the control unit 10 is necessary so that setting content set in the administration device can be reflected in execution content of the control section 16. Settings etc. in the setting screen 50 are realized through the administration device.

Next, processing performed by the game control section 16A and switching processing that the switch program 41 causes the control section 16 to perform through the switch control section 16B will be described. The game control section 16A performs processing to start a game when a start condition to start the game is met and to end the game when an end condition to end the game is met while the game is played. For example, whether the start condition is met may be determined such that the start condition is met in a case when the predetermined game value is bet. When the end condition of the game is met, the game control section 16A may cause the display device 6 to display a game result. The above processing is well known and a detailed description thereof is omitted.

Figure 7:
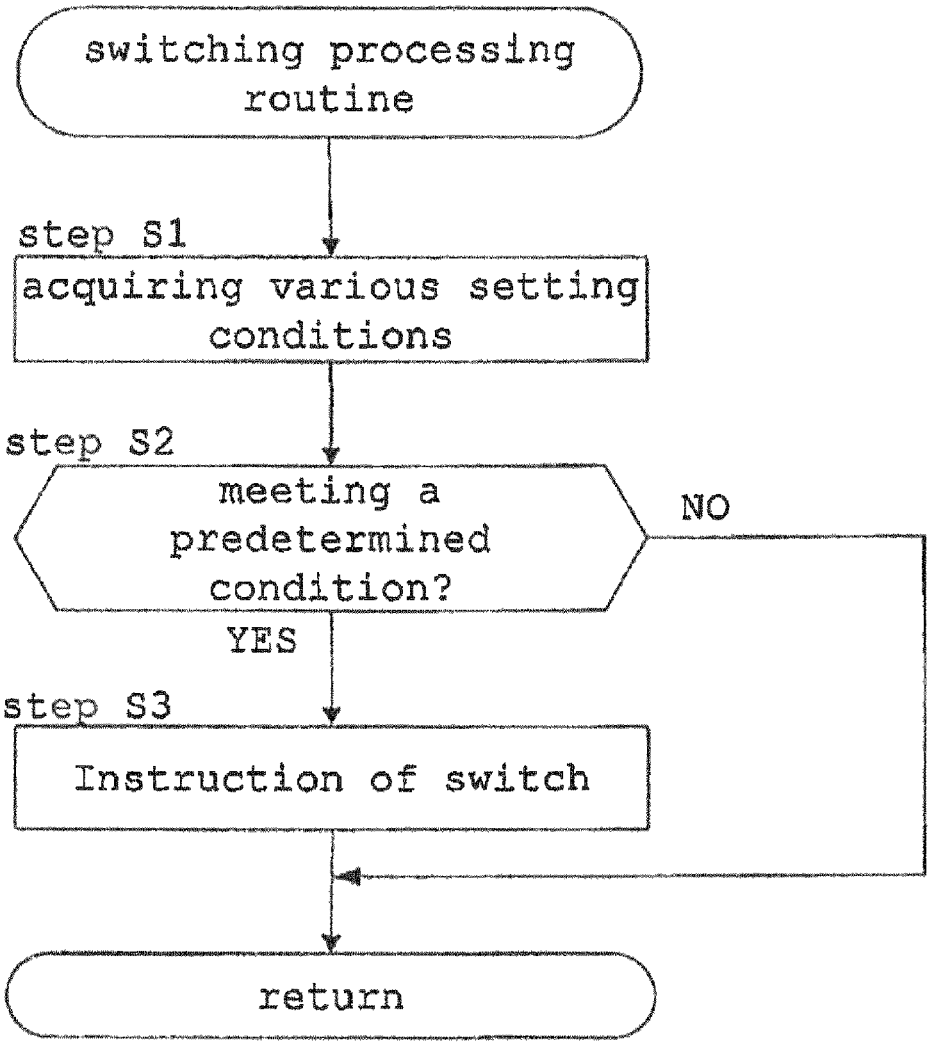
FIG. 7 is a diagram exemplifying a flow chart of a switching processing routine.

FIG. 7, on the other hand, is a diagram exemplifying a flow chart of a switching processing routine that the switch program 41 causes the control section 16 to perform through the switch control section 16B. The switch control section 16B generated in the control section 16 by the switch program 41 performs the routine in FIG. 7 each time the game played in the gaming machine 1A ends. That is, switching processing like an example in FIG. 7 is realized by the switch program 41. The switch program 41 serves as a determination device and a switching device by causing the control unit 10 to perform the routine like FIG. 7 through the control section 16.

When the routine in FIG. 7 is started, in step S1, the switch control section 16B acquires various setting conditions set through the setting screen 50. Subsequently, in step S2, the switch control section 16B determines whether the game played last time (the game ended immediately before) meets a predetermined condition based on the setting conditions acquired in step S1. This determination is made, for example, as described below.

In step S2, the switch control section 16B first determines whether the game played last time meets the event start condition as a predetermined condition. To describe the determination by using the example in FIG. 6 as an example, this determination is realized by determining whether the game played last time is the first game GA of the first game file 21 using 85% Paytable and the number of times of playing the first game GA is the 200th. The determination whether or not the 200th can be realized by, for example, using a number that is counted up each time the first game GA of the first game file 21 using 85% Paytable is played and reset when the event start condition is met. When a result of the determination is negative, that is, the game played last time is not the 200th first game GA of the first game file 21 using 85% Paytable, in step S2, the switch control section 16B determines that the predetermined condition is not met. On the other hand, the game played last time is the 200th first game GA of the first game file 21 using 85% Paytable, that is, the a result of the determination is positive, in step S3, the switch control section 16B determines that the predetermined condition is met.

The determination whether the event start condition is met is not limited to such a form. For example, lots may be drawn each time a game is started to determine whether the predetermined condition is met based on the lots. In this case, if, for example, like the example in FIG. 6, "1 in 200 games" is set in the Cycle field 53 as Event Cycle, lots may be drawn in such a way that the theoretical probability of meeting the predetermined condition becomes 1/200. Such processing may be configured to be performed by, for example, the switch program 41 through the switch control section 16B.

In step S2, the switch control section 16B also determines whether the game after switching meets the predetermined condition. That is, in step S2, the switch control section 16B determines for the game after the last game being switched as an event whether the event end condition is met as the predetermined condition. Whether the event end condition is met is determined, for example, as follows.

First, when the game is a game after the last game being switched as an event, the switch control section 16B determines the number of times of playing the game after the last game being switched. To describe the determination by using the example in FIG. 6 as an example, this determination is realized by acquiring the number of times of playing the second game GB played last time and using the acquired number of times of playing the game. Whether the second game GB played last time is played as an event after the event start condition being met may be determined by using, for example, a flag and the like that is attached to a game which is played as an event after the event start condition being met, and that is deleted after the event ends. How many times the second game GB has been played as an event may be realized by using a number that is counted up each time the second game GB is played after the attachment of a flag and the like indicating the start of an event and is reset with the deletion of the flag and the like. The switch control section 16B determines whether the predetermined condition is met by determining that the event end condition is not met if the number of times of playing the second game GB is once to four times and the event end condition is met if the number of times of playing the second game GB is five times.

The switch control section 16B determines in step S2, as described above, whether the event start condition or the event end condition is met as the predetermined condition. When the switch control section 16B determines that the predetermined condition is not met, the switch control section 16B ends the routine this time by skipping subsequent steps. On the other hand, when the switch control section 16B determines in step S2 that the predetermined condition is met, the switch control section 16B proceeds to step S3.

In step S3, the switch control section 16B determines the game to be played after switching based on various setting conditions acquired in step S1 and issues instructions of the game to be played next time to the game control section 16A so that the game is switched from the game last time to the game next time based on the determination result. To describe, for example, by using the example in FIG. 6, when the switch control section 16B determines in step S2 that the event start condition is met, in step S3, the switch control section 16B issues instructions of the second game GB of the second game file 22 using 250% Paytable as the game to be played next time to the game control section 16A. On the other hand, when the switch control section 16B determines in step S2 that the event end condition is met, in step S3, the switch control section 16B issues instructions of the first game GA of the first game file 21 using 85% Paytable as the game to be played next time to the game control section 16A. Accordingly, when the event start condition is met, the game is switched from the first game GA of the first game file 21 using 85% Paytable to the second game GB of the second game file 22 using 250% Paytable. On the other hand, when the event end condition is met after starting the event, the game is switched from the second game GB of the second game file 22 using 250% Paytable to the first game GA of the first game file 21 using 85% Paytable. If processing in step S3 is finished, the switch control section 16B terminates the routine this time.

As the predetermined condition in step S2, after an event is started, a still another event start condition may be determined. In this case, in step S3, for example, the game may be switched to another game such as a third game provided with a condition still more favorable to the player. The game which is switched to after the event ends is not limited to the original game. That is, the form is not limited to one in which the original game is selected as the game switched to after an event is started and any game made be selectable. After switching is instructed, guidance that the next game is different from the last game and characteristics of the next game may be guided to the player. The guidance may be provided after switching is instructed before a result of the game actually played next time appears. The guidance may be provided by either of the game control section 16A or the switch control section 16B. For example, the function to provide such guidance may be added by the switch program 41 and be executed by the switch control section 16B.

According to the extended device 40 in this embodiment, as described above, when a predetermined condition is met, the game played in the gaming machine 1A is switched from the first game GA by the first game file 21 to the second game GB by the second game file 22. Thus, the second game GB can be incorporated into the flow of the first game GA. Accordingly, the gaming machine 1A can be caused to play a new game that mutually combines the games GA, GB, each of which is alternatively played. The second game after switching is more favorable to the player than the first game. Thus, the second game after switching can be used as an event. Accordingly, the game can be made more interesting. The extended device 40 is physically a separate device from the external storage device 20. Thus, in addition to the external storage device 20, the extended device 40 can be connected to the control device 10 later. Therefore, the game files 21, 22 stored in the external storage device 20 in advance can be used as they are without modification thereof to provide a new game.

For example, in commercially available games, contents thereof cannot be modified at home since programs and the like to realize such games are stored in a DVD-ROM or the like. Thus, even if there is a plurality of DVD-ROMs or the like and a plurality of games can be played by using such DVD-ROMs, each DVD-ROM or the like is used merely alone so that the single game realized by each DVD-ROM is simply played. However, according to the extended device 40, each game stored in each of such DVD-ROMs or the like can be combined and used. That is, according to the extended device 40, a new game can be provided by combining and using game programs, etc. in existing DVD-ROMs or the like as they are without modification.

Some kinds of game require making an application to obtain approval and licenses to modify or add a game file, etc. Thus, for such a game, making an application, etc. is necessary each time, for example, Paytable of a new payout ratio is added. Thus, time and efforts are needed to add or modify a plurality of kinds of Paytables. On the other hand, some other game files permitted and stored in the external storage device may have Paytable of other games similar to Paytable of a payout ratio obtained by addition or the like. Moreover, a game similar to a game using Paytable of a payout ratio obtained by addition or the like may be played by appropriately combining other games files stored in the external storage device in advance. In such cases, according to the extended device 40, the gaming machine 1A can be caused to play a game by using the permitted game files 21, 22. Thus, if approval and licenses of the switch program 41 stored in the extended device 40 are obtained, there is no need to make an application or the like each time a game file is modified or the like. Accordingly, since costs of time, efforts and the like needed to make an application or the like can be reduced, nature of an existing game can be changed efficiently.

The present invention is not limited to the above embodiment and can be carried out in a suitable embodiment. In the above embodiment, the game files 21, 22 stored in the external storage device 20 are games of the same rules and are configured to cause the gaming machine 1A to play games using different Paytables. However, each game file is not limited to such a form. For example, each game file stored in the external storage device 20 may be configured to play games which use a plurality of common game symbols and have mutually different kinds of benefit attendant on prize-winning conditions. As one of such games, the so-called slot machine type game may be played. That is, the slot machine type game is a game in which a play is provided after game value being bet and if identical symbols are collected in predetermined arrangement in a plurality of columns during the play (as an example, three identical symbols are collected adjacent to each other), a predetermined prize-winning condition is determined to be established and the game value in accordance with the bet amount is paid out. In this case, as an example of games having different kinds of benefit, the first game file 21 may be configured as a game that pays out the game value as a prize-winning benefit and the second game file 22 may be configured as a game that provides an opportunity to play a game a fixed number of times as a prize-winning benefit without consuming the game value. Accordingly, the gaming machine can be caused to play a repeated prize-winning game in which a prize-winning opportunity is repeatedly provided without the need to consume the game value when the predetermined condition is met. The player can easily be made to recognize that different games are being played. In this case, the game caused to play by the second game file 22 may be configured so that the game value is paid out as a prize-winning benefit depending on the kind of the symbol causing prize-winning conditions to be established. Further, as Paytable used by the second game file 22, Paytable whose payout ratio is higher than the payout ratio of Paytable of the first game file 21 may be used. Accordingly, since a game with a high payout ratio of the game value is repeatedly provided without the need to consume the value, expectations of the player to win a prize may be possibly further raised.

In the above embodiment, even if rules are the same, games of different content of benefit like the payout ratio are played. Also, games using symbol marks and having quite different content of benefit are played. For example, if symbol marks form a predetermined arrangement, the game value is paid out in one game and free games are provided in another game as a benefit. That is, in the above embodiment, each game is played as a game in which at least one benefit is provided after a predetermined prize-winning condition is established and a portion or all of benefit content is mutually different. However, each game played by a gaming machine according to the present invention is not limited to such an embodiment. For example, game files stored in the external storage device 20 may each be configured to cause the gaming machine 1A to play games of mutually totally different rules. In this case, making the player play a plurality of kinds of games is possible. Accordingly, the games can be made more interesting and also the player can be made to clearly recognize changes and the like attendant on an event occurrence.

In the above embodiment, the first game program 31 to realize the first game GA and the second game program 35 to realize the second game GB are provided separately, however the present invention is not limited to such a form. For example, one game program shared to realize both the first game and the second game may be prepared as a program to realize each game. In this embodiment, the first game and the second game are realized by first game data and second game data having at least partially different content being alternatively used. In this case, the shared game program and first game data correspond to the program and data contained in the first game file respectively. On the other hand, the shared game program and second game data correspond to the program and data contained in the second game file respectively. Conversely, one piece of data shared by both the first game and the second game may be prepared as game data used to realize each game. In this embodiment, the first game and the second game are realized by the first game program or the second game program using the common game data being alternatively executed. In this case, the first game program and the shared game data correspond to the program and data contained in the first game file respectively. On the other hand, the second game program and the shared game data correspond to the program and data contained in the second game file respectively. In these cases, the region where the first game file is stored functions as a first game region and the region where the second game file is stored functions as a second game region.

Figure 8:
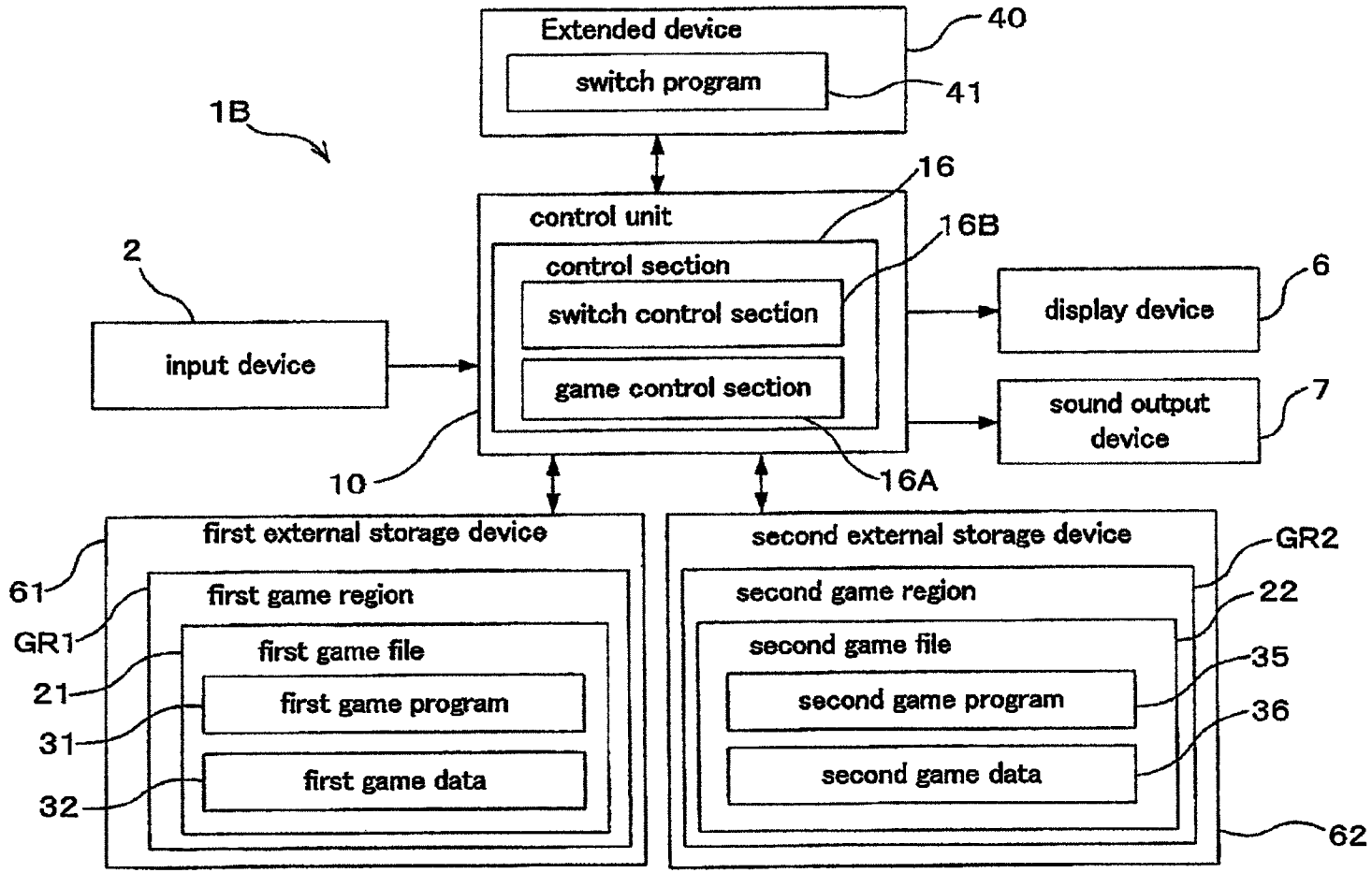
FIG. 8 is a functional block diagram of the gaming machine according to a modification of the embodiment.

In the above embodiment, the first game region GR1 to store the first game file 21 and the second game region GR2 to store the second game file 22 are provided in the external storage device 20 in common, however the present invention is not limited to such an embodiment. For example, the first game region GR1 to store the first game file 21 and the second game region GR2 to store the second game file 22 may be provided in two physically different external storage devices. FIG. 8 is a functional block diagram of the gaming machine according to a modification. The same reference numerals are attached to elements common to FIG. 1 and a description thereof is omitted. As shown in FIG. 8, two physically different external storage devices 61, 62 are connected to the control unit 10. The first game region GR1 containing the first game file 21 is provided in the first external storage device 61 as one first game file storage device. The second game region GR2 containing the second game file 22 is provided in the second external storage device 62 as the other second game file storage device. That is, the switch program 41 may switch the game played in a gaming machine 1B between the game files 21, 22 stored in the physically different external storage devices 61, 62 respectively.

The present invention is not limited to an embodiment in which each game file is stored in the physically same game file storage device for each game file. For example, when three storage devices are used as game file storage devices, the first game program and the second game program may be stored in one game file storage device with the first game data stored in one of the other two game file storage devices and the second game data stored in the other game file storage device. That is, the program and data contained in the first game file (or the second game file) may be stored in physically different game file storage devices. The extended device 40 may function as a game file storage device. That is, at least one of the program and data used to realize the first game may be stored in the extended device. Alternatively, one of the first game region GR1 and the second game region GR2 may be provided in the extended device.

In the above embodiment, two games are shown as games played in each of the gaming machines 1A, 1B, however a plurality of games exceeding two may be played in the gaming machine. In this case, only having a relationship similar to the relationship between the first game GA and the second game GB in the above embodiment between one of a pair of games of the plurality of games is necessary.

In the above embodiment, the predetermined number of times is used as a predetermined condition for the switch program 41 to perform switching. In this case, since the game is switched in accordance with the number of plays, the player can be motivated about the number of plays. However, the present invention is not limited to such an embodiment. For example, as the predetermined condition, various conditions such as a case when a specific prize-winning condition is established during the play, a case when a predetermined item is selected, a case when the game value of a fixed amount or more is consumed at a time (bet at a time), and a specific time may be adopted. Similarly, the event end condition is not limited to a form of using the number of plays. For example, as the event end condition, various conditions such as a case when a specific prize-winning condition is established during the play, a case when a predetermined item is selected, and a case when a fixed time passes may be used. Similarly, various conditions in accordance with the played game may be used as the prize-winning condition. For example, as the prize-winning condition, various conditions such as a case when a specific prize-winning condition is established during the play and a case when a predetermined item is selected may be used. Further, a game result may be used as a predetermined condition so that the game is switched in accordance with the game result.

In the above embodiment, the game value is consumed to play a game, however the present invention is not limited to such an embodiment. For example, each game file may be configured to cause the gaming machine to play a game that provides an opportunity of play without consuming the game value. As an example of the gaming machine capable of playing without consuming the game value, the present invention may be applied to home gaming machines. In the above embodiment, games in which a benefit is provided after a predetermined prize-winning condition is established are played, however each game played in a gaming machine according to the present invention is not limited to such an embodiment. For example, like a game played in a home gaming machine, a game in which no opportunity of establishment of the predetermined prize-winning condition during the play may be played. Thus, each game may be a game in which no benefit attendant on establishment of the predetermined prize-winning condition is provided. Moreover, the game may be switched between games provided by different vendors. In this case, games of different vendors that do not originally assume switching can be combined.

In the above embodiment, when a predetermined condition is met, the game is switched from a game of lower payout ratio to a game of higher payout ratio. Alternatively, the game is switched to a repeated prize-winning game in which a prize-winning opportunity to establish a prize-winning condition is provided a fixed number of times without consuming the game value. Further, as a repeated prize-winning game after switching, the game may be switched to a game in which a plurality of benefits is provided such as playing a game of higher payout ratio than the payout ratio before switching. That is, in the above embodiment, when a predetermined condition is met, the game is switched so that favorable benefit is provided to the player. However, the present invention is not limited to such an embodiment. For example, in contrast to the above embodiment, switching between games may be performed in such a way that a benefit condition becomes unfavorable to the player such as switching from a game of higher payout ratio to a game of lower payout ratio.

What is claimed is:

1. A gaming machine comprising:

a game file storage device provided with a first game region in which a first game file containing a program and data to realize a first game is stored and a second game region in which a second game file containing a program and data to realize a second game is stored, in which the first game and the second game are selectively played, and an extended device connected to the gaming machine as a physically separate device from the game file storage device, wherein the extended device is provided with a determination device that determines whether a predetermined condition is met and a switching device that switches a game played in the gaming machine between the first game and the second game when the predetermined condition is met based on a determination result of the determination device.

2. The gaming machine according to claim 1, wherein the first game and the second game are played as games in which at least one benefit is provided after a predetermined prize-winning condition is established and in which at least a portion of the benefit is mutually different.

3. The gaming machine according to claim 2, wherein the games in which an opportunity to establish the predetermined prize-winning condition is provided by consumption of a game value, in which the game value is paid out as the one benefit after the predetermined prize-winning condition is established, and in which mutually different payout ratios obtained by dividing an amount of the paid-out game value by the amount of consumption of the game value are played as the first game and the second game, respectively.

4. The gaming machine according to claim 3, wherein the determination device determines whether the predetermined condition is met on the lower payout ratio of either the game of the first game or the second game, and if the predetermined condition is met on the lower payout ratio, the switching device switches the game played in a gaming machine from the game of the lower payout ratio to a game of a higher payout ratio.

5. The gaming machine according to claim 2, wherein the game in which an opportunity to establish the predetermined prize-winning condition is provided a fixed number of times without consumption of a game value as the at least one benefit is played as any one of the first game and the second game, the determination device determines whether the predetermined condition is met on the other one of the first game and the second game, and if the predetermined condition is met on the other game, the switching device switches the game played in the gaming machine from the other game to the one game.

6. The gaming machine according to claim 1, wherein the games having mutually different rules are played as the first game and the second game.

7. The gaming machine according to claim 1, wherein the determination device determines that the predetermined condition is met when any one of the first game and the second game is played a predetermined number of times, and the switching device switches the game played in the gaming machine from the one game of the first game and the second game to the another game with respect to the one game.

8. The gaming machine according to claim 2, wherein the determination device determines that the predetermined condition is met when any one of the first game and the second game is played a predetermined number of times, and the switching device switches the game played in the gaming machine from the one game of the first game and the second game to the another game with respect to the one game.

9. The gaming machine according to claim 4, wherein the determination device determines that the predetermined condition is met when any one of the first game and the second game is played a predetermined number of times, and the switching device switches the game played in the gaming machine from the one game of the first game and the second game to the another game with respect to the one game.

10. The gaming machine according to claim 5, wherein the determination device determines that the predetermined condition is met when any one of the first game and the second game is played a predetermined number of times, and the switching device switches the game played in the gaming machine from the one game of the first game and the second game to the another game with respect to the one game.

11. The gaming machine according to claim 6, wherein the determination device determines that the predetermined condition is met when any one of the first game and the second game is played a predetermined number of times, and the switching device switches the game played in the gaming machine from the one game of the first game and the second game to another game with respect to the one game.

12. The gaming machine according to claim 1, further comprising a first game file storage device and a second game file storage device, wherein the first game file storage device and the second game file storage device are physically separate, and the first game region is provided in the first game file storage device and the second game region is provided in the second game file storage device.

13. The gaming machine according to claim 2, further comprising a first game file storage device and a second game file storage device, wherein the first game file storage device and the second game file storage device are physically separate, and the first game region is provided in the first game file storage device and the second game region is provided in the second game file storage device.

14. The gaming machine according to claim 4, further comprising a first game file storage device and a second game file storage device, wherein the first game file storage device and the second game file storage device are physically separate, and the first game region is provided in the first game file storage device and the second game region is provided in the second game file storage device.

15. The gaming machine according to claim 5, further comprising a first game file storage device and a second game file storage device, wherein the first game file storage device and the second game file storage device are physically separate, and the first game region is provided in the first game file storage device and the second game region is provided in the second game file storage device.

16. The gaming machine according to claim 6, further comprising a first game file storage device and a second game file storage device, wherein the first game file storage device and the second game file storage device are physically separate, and the first game region is provided in the first game file storage device and the second game region is provided in the second game file storage device.

17. An extended device being connected to a gaming machine, the gaming machine including a game file storage device provided with a first game region in which a first game file containing a program and data to realize a first game is stored and a second game region in which a second game file containing a program and data to realize a second game is stored, and the first game and the second game are selectively played therein, wherein the extended device is connected to the gaming machine as a physically separate device from the game file storage device, and the extended device comprising:

a determination device that determines whether a predetermined condition is met; and a switching device that switches a game played in the gaming machine between the first game and the second game when a predetermined condition is met based on a determination result of the determination device.

* * * * *